US006277331B1

(12) United States Patent
Konrad

(10) Patent No.: US 6,277,331 B1
(45) Date of Patent: Aug. 21, 2001

(54) HOLDING DEVICE FOR BODY FLUIDS AND TISSUES

(75) Inventor: Franz Konrad, Regau (AT)

(73) Assignee: C. A. Greiner & Söhne Gesellschaft mbH, Kremsmünster (AT)

( * ) Notice: Subject to any disclaimer, the term of this patent is extended or adjusted under 35 U.S.C. 154(b) by 0 days.

(21) Appl. No.: 09/230,771

(22) PCT Filed: Aug. 1, 1997

(86) PCT No.: PCT/AT97/00180

§ 371 Date: Oct. 15, 1999

§ 102(e) Date: Oct. 15, 1999

(87) PCT Pub. No.: WO98/05426

PCT Pub. Date: Feb. 12, 1998

(30) Foreign Application Priority Data

Aug. 2, 1996 (AT) ..... 1386/96

(51) Int. Cl.[7] ..... B65D 39/00; B01L 3/14

(52) U.S. Cl. ..... 422/102; 422/101; 422/916; 220/916; 215/247; 215/274; 210/516

(58) Field of Search ..... 422/102, 916, 422/918, 101, 72; 210/789, 515, 516; 215/247, 274; 220/916

(56) References Cited

U.S. PATENT DOCUMENTS

| | | | |
|---|---|---|---|
| 3,081,029 | | 3/1963 | Gauslaa . |
| 3,434,615 | | 3/1969 | Barletta . |
| 3,508,653 | | 4/1970 | Coleman . |
| 3,897,343 | | 7/1975 | Ayres . |
| 4,083,788 | * | 4/1978 | Ferrara . |
| 4,259,184 | * | 3/1981 | D'Arnal . |
| 4,279,863 | | 7/1981 | Friehler . |
| 4,342,724 | * | 8/1982 | Narra . |
| 4,465,200 | * | 8/1984 | Percarpio . |
| 4,927,013 | * | 5/1990 | Van Brunt et al. . |
| 4,957,637 | | 9/1990 | Cornell . |
| 5,294,011 | * | 3/1994 | Konrad et al. . |

FOREIGN PATENT DOCUMENTS

| | | |
|---|---|---|
| 195 13 453 A1 | 4/1995 | (DE) . |
| 0 638 804 A1 | 2/1995 | (EP) . |
| 0 753 741 A1 | 1/1997 | (EP) . |
| WO 93/22674 | 11/1993 | (WO) . |
| WO 96/05770 | 2/1996 | (WO) . |

* cited by examiner

*Primary Examiner*—Joseph W. Drodge
*Assistant Examiner*—Terry K. Cecil
(74) *Attorney, Agent, or Firm*—Collard & Roe, P.C.

(57) ABSTRACT

A holding device for body fluid, tissue parts and tissue culture media includes a cylindrical holding container having a container wall with an inner surface defining an inner space, a first open end face having a diameter which is at least equal to the diameter of the inner space, and a second open end face having a conical sealing surface tapering inwardly in the direction of the inner space. A first closure device closes the first open end face and a second closure device closes the second end face. The second closure device includes a solid conical seal body 44 having a sealing surface conforming to the conical sealing surface of the second open end face and an outer end face of a larger diameter than that of an inner end face that faces the inner space. A retaining member 45 abuts the outer end face and is coupled to the outer container wall surface for holding the seal body in a sealing position in the second open end face.

32 Claims, 7 Drawing Sheets

1
21
25
39
34
30
32
8
27
6
38
35
28
31
33
29
41
22
43
40
24
36
37
23
71
26
68
42
72
70
69
11
18
14
73
10
5
12
19
13
2
20
3
15
4
16
56
17
55
54
57
58
44
61
47
50
67
66
60
7
9
45
59
48
46
62
63
49
52
64
II
53
51

HOLDING DEVICE FOR BODY FLUIDS AND TISSUES

BACKGROUND OF THE INVENTION

1. Field of the Invention

The invention relates to a holding device for body fluids, tissue parts and cultures.

2. Description of the Prior Art

From WO 93/22647 A1 a method and a device for separating a mixture of at least two media is known, in which the holding container is in the form of an approximately cylindrical or tubular housing with a container wall, which surrounds an inner space and the holding container has two end areas with open end sides respectively spaced apart from one another in the direction of its longitudinal medial axis. These two openings can be closed by if necessary openable closure devices, whereby one of which overlaps the holding container on its outer surface and the other closure device is designed such that the latter comprises a penetrable seal body and a holding element for the seal body, whereby the seal body is inserted into the inner space of the holding container and the holding element overlaps the holding container in the region of its outer surface. Furthermore, a separating device is inserted into the inner space of the holding container, which is designed by a main body with sealing lips projecting therefrom.

A holding container for centrifuging is known from U.S. Pat. No. 3,434,615 A, which is formed by a container body designed to be open at one end, which has a neck-like projection, whereby an inner surface of the neck-like projection is designed to taper conically in the direction of the inner space. In this conically designed neck region a diametrically opposed conically designed seal device in the form of a seal stopper with sealing rings arranged on the circumference can be used, whereby the seal stopper is held on the side of a flange of a cap relative to the housing opposite the inner space of the housing. In addition, between the cap and the housing a screw thread is arranged, with which the cap can be screwed into the housing or its neck-like projection. Because of the interaction of the seal stopper and the cap on the one hand and between the cap and the neck-like projection of the housing on the other hand, the seal stopper can be brought into a sealed position on the conical seal surface.

An additional holding device for blood is known from U.S. Pat. No. 3,897,343 A, in which the separating device is arranged before the insertion of the media to be separated in the region of the closed end side of the holding container. In the region of the open end face of the holding container a penetrable closure device is arranged, which is penetrated by a needle to insert the medium into the inner space of the holding device, and then the medium is introduced into the inner space. In this way the separating device before the commencement of the separating process is below the medium to be separated and only floats up after applying centrifugal force because of the selected specific weight to the separated and heavy components of the medium, and only after the end of loading by centrifugal force adopts a sealing position between the two separated components of the medium. A disadvantage of this known method or known device is that the separating device comes into contact with both components of the medium before the separating process begins, and it is thereby possible that partial amounts of the heavy medium stick in the region above the seal device on the separating device, and thus afterwards a mixing or polluting of the lighter medium above the separating device is possible after the completion of the separating process.

Furthermore, there is already known a holding device for the mixture of at least two media, according to DE-A1-19 513 453, which has a test-tube-like holding container, which is closed at an open end face area by a closure device, and in which there is inserted a separating device for holding apart the various media of the mixture after separation. In order to prevent the end face of the separating device, which subsequently comes into contact more with one medium, from being contaminated while the mixture is being filled into the inner space of the container, the separating device is provided in its central area with a through opening, through which the mixture can be introduced into the remaining inner space of the holding container. During the following separating procedure by centrifuging in a previously known way with a radial centrifugal force (rcf) of 1,000 g to 5,000 g, g being gravitational force and 1 g having a value of 9.81 m/s2, one of the media separated from the mixture is transferred through the aperture in a separating device into the area located between the seal device and the separating device and as a result sinks in the direction of the closed end of the holding container. In order to prevent the medium between the closed end and the separating device, after separation through the aperture, from mixing again with the medium separated therefrom, there is provided at a level corresponding to the normally remaining quantity of the other medium an end stop expanding conically in the direction of the closed end, by means of which the separating device impinges on the end stop which penetrates through the aperture. As soon as the outer diameter of the end stop corresponds to the inner diameter of the aperture, the separating device remains in this position, the aperture is closed by the stop, and no interchange or repeated admixture of the two media can take place. A disadvantage in this variant is that a special tube with an internally-located stop must be produced, and reliable separation of the media, due to the aperture located in the separating device, cannot be guaranteed.

Other holding devices for centrifuging mixtures to be separated consisting of at least two different media, in which the holding container is closed at both end face areas by a closure device, are known from WO-A1 96/05770. Located in the interior is a separating device in the form of a sealing disc, which is formed by a gel. During centrifuging this gel plug, due to its specific weight, which is higher than the specific weight of the medium with the lower specific weight, and is lower than the specific weight of the medium with the higher specific weight, migrates due to the centrifugal forces acting thereon between the two different media separated from one another. In this positioned location a separation of one medium from the other medium of the mixture can thus take place. A disadvantage here is that the storage time, due to the separating device made of gel, is in many cases insufficient for normal duration of use.

The object underlying the present invention is to provide a holding container, a holding device, and a method of separating a plurality of media of a mixture, which may be rapidly adapted to various mixtures, and enables a long storage period and a high degree of operational reliability, even when used by unskilled personnel.

SUMMARY OF THE INVENTION

This and other objects are accomplished according to this invention with a holding device for body fluid, tissue parts and tissue culture media, which comprises a cylindrical holding container having a container wall with an inner surface and an outer surface, the holding container having a first and a second open end face, the inner container wall surface defining an inner space, the first open end face having a diameter which is at least equal to the diameter of the inner space, and the second open end face having a conical sealing surface tapering inwardly in the direction of the inner space; a first closure device for closing the first open end face, the first closure device including a cap surrounding the outer container wall surface, two extensions projecting inwardly from a cylindrical inner surface towards a longitudinally extending medial axis of the holding container, the extensions being arranged in planes extending perpendicularly to the medial axis and being spaced apart in the direction of the medial axis, and a penetrable cylindrical seal device mounted in the cap, a first portion of the seal device forming a sealing surface with the inner container wall surface, and an adjacent flange-shaped seal device portion projecting radially outwardly and being held between the two extensions, one of the extensions projecting inwardly between the first and adjacent portions of the cap; and a second closure device for closing the second open end face, the second closure device including a solid conical seal body having a sealing surface conforming to the conical sealing surface of the second open end face, and an outer end face of a larger diameter than that of an inner end face facing the inner space, a retaining member abutting the outer end face, and coupling means on the outer container wall surface, the retaining member having means for engaging the coupling means and for holding the seal body in a sealing position in the second open end face.

If the diameter of the outer end face of the conical seal body is greater than the greatest diameter of the conical sealing surface of the second open end face, and the diameter of the inner end face of the conical seal body is greater than the smallest diameter of the conical sealing surface of the second open end face, an adequate bias of the seal body can be achieved.

If the retaining member has a cross section that no more than slightly exceeds the outer cross section of the tubular container, the container may be readily inserted in conventional centrifuges.

Preferably, the holding device comprises a separating device arranged in the inner space, the separating device comprising a sealing member contacting the inner container wall surface and comprised of a deformable, resiliently restorable first material, and a carrier body comprised of a second material, the sealing member being arranged on the circumference of the carrier body and radially projecting therefrom towards the inner container wall surface.

The second material preferably has a higher density and/or hardness than the first material and may be a thermosetting plastic or polystyrene. It may have a density between 1.03 g/cu.cm and 1.06 g/cu.cm. This imparts permanent durability to the carrier body, and it also makes possible the separation of liquids of differing specific gravities or densities, in a wide variety of applications, especially in blood analysis.

The separating device will produce precise separation of differing media and have a high degree of impermeability if the carrier body is liquid-impermeable and has a gas permeability of at least 72 hours. The sealing member is preferably molded onto the carrier body and may be an O-ring or a sealing lip, and has a gas permeability at least equal to that of the carrier body.

According to a preferred embodiment, the carrier body has a lower end face, an upper end face and a side wall extending therebetween, a diagonal distance between a point of intersection between the lower end and the side wall and a point of intersection between the upper end face and the side wall exceeding the diameter of the inner space. The axis of rotation of such a carrier body will not assume a position perpendicular to the medial longitudinal axis during centrifuging when subjected to different centrifugal forces.

If at least one of the sealing members is eccentrically arranged in relation to the medial axis, the separating device will be properly returned to its initial position in the container at the end of a centrifuging operation.

The separating device will be precisely positioned before use, or until centrifuging starts, by providing a securing device for detachably attaching the separating device to one of the closure devices. For example, the carrier body may have two end faces extending perpendicularly to the medial axis, and the securing device comprises a retaining extension projecting from one of the carrier body end faces and received in a securing recess in the one closure device. The retaining extension and the securing recess are preferably disposed in the medial axis.

BRIEF DESCRIPTION OF THE DRAWING

The invention will be explained in more detail in the following with reference to embodiments given by way of example and illustrated in the drawings.

Shown are.

DETAILED DESCRIPTION OF PREFERRED EMBODIMENTS

It should firstly be stated that in the variously described embodiments, identical parts are provided with identical reference numbers or identical component titles, the disclosures contained in the entire description also meaningfully applying to identical parts with identical reference numbers or identical component titles. Also, the directions given in the description, such for example as top and bottom, are to be taken to refer only to the view stated here, and are to be transferred to this new position in the case of an alteration in position. Furthermore, individual features from the various embodiments shown can represent in themselves independent solutions according to the invention.

Figure 1:
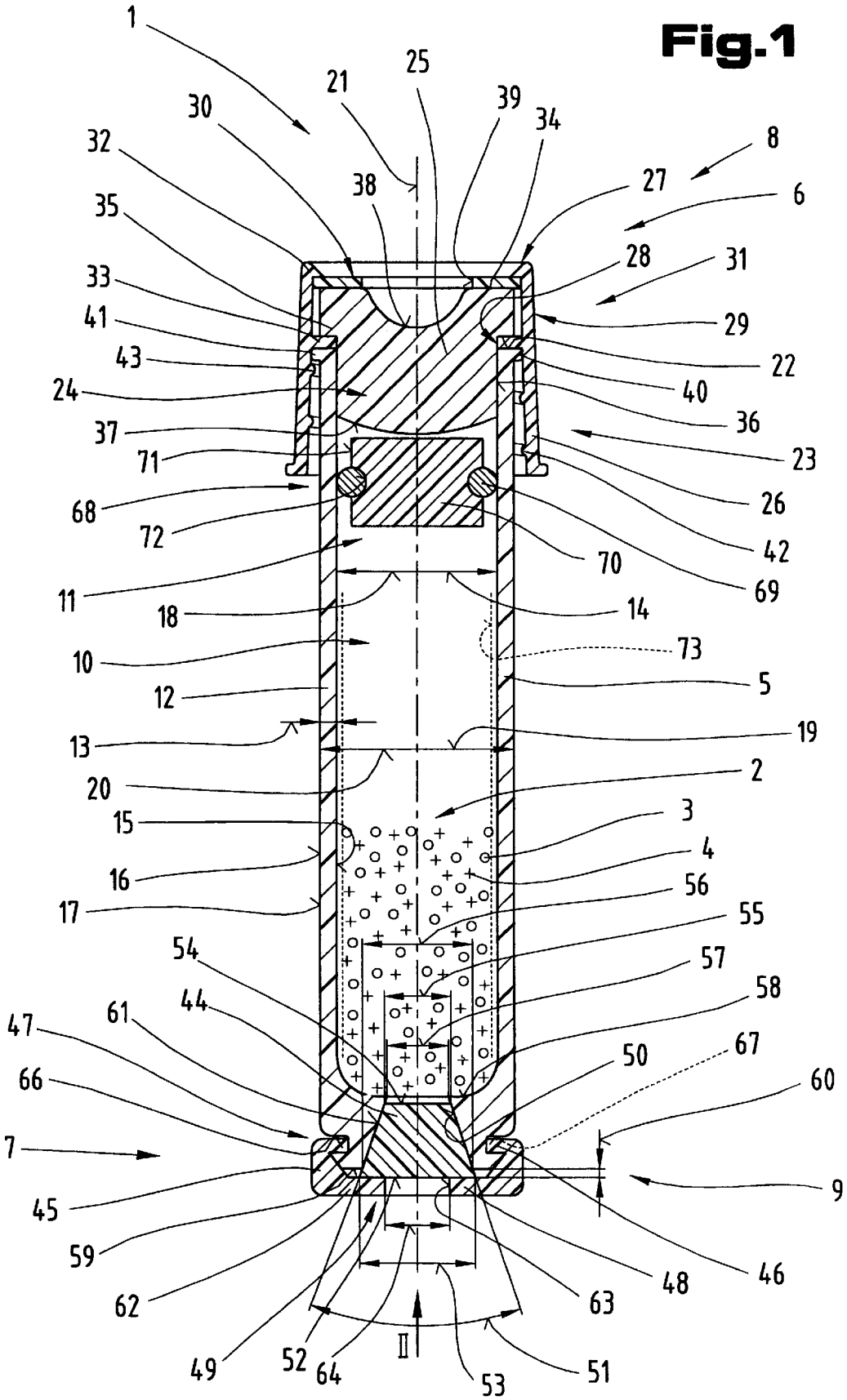
FIG. 1: a holding device designed according to the invention, e.g. for blood, in a side elevation, in section and in a simplified schematic view.
Figure 2:
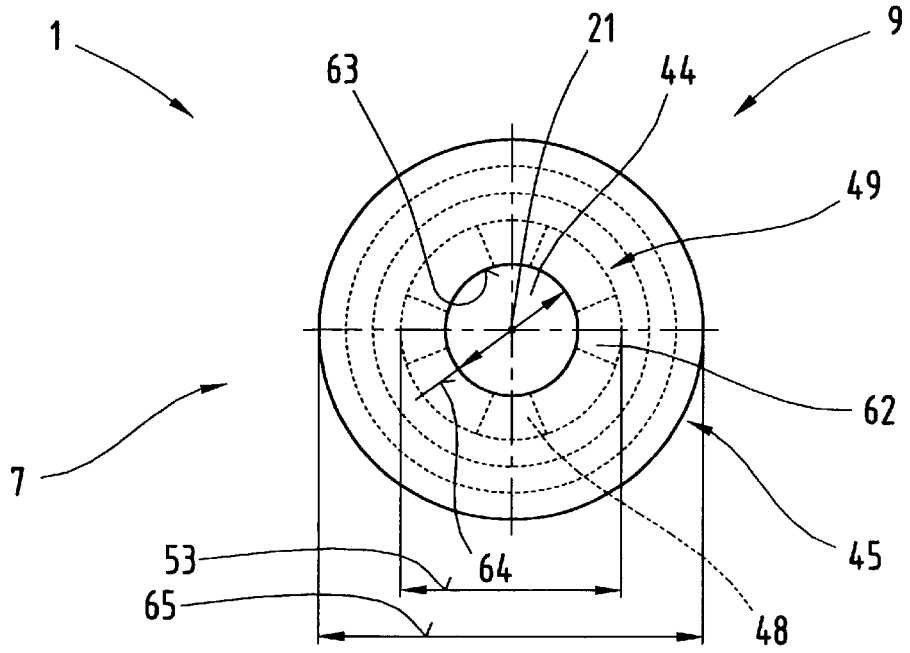
FIG. 2: the holding device according to FIG. 1 in a view from below according to an arrow II in FIG. 1.

FIGS. 1 and 2 show a holding device 1 for a mixture 2 of at least two differing ingredients or media 3, 4, such for example as body fluids, tissue parts or tissue cultures, and which is so designed that the mixture 2 located in the holding device 1 is separable into at least two of its ingredients. This separation or parting of the mixture 2 into its ingredients or media 3, 4 may for example be effected physically by centrifuging in a way known per se and may be carried out from the position of rest until a radial centrifugal force (rcf) of 1,000 g to 5,000 g, preferably 2,200 g is reached, g being gravitation and 1 g being a value of 9.81 m/s2. Thus for example it is possible to separate the solid phase from the liquid phase, as will be described in more detail in the following Figures.

The holding device 1 comprises a roughly cylindrically shaped holding container 5 with closure devices 8, 9 located at end regions 6, 7 spaced apart from one another, and a separating device 11 inserted in an inner space 10 surrounded by the holding container 5. This holding container 5 may also for example be designed or used as an evacuated blood sample removal test tube.

The holding container 5 may for example be in the shape of a bottle, phial, piston or the like, and may be formed from the most varied materials, such for example as plastics or glass. If plastics are selected as a material for the holding container, this can be liquidtight, particularly water-tight or if necessary gas-tight, and may consist for example of polypropylene (PP), polyethylene (PE), high-density polyethylene (PE-HD), acrylonitrite-butadiene-styrol-copolymers (ABS) or the like, or of a combination of these. Furthermore, the holding container 5 has a container wall 12 with a wall thickness 13, the container wall 12, extending from one end area 6 with substantially identical internal dimension 14 towards the other end area 7. The container wall 12 of the holding container 5 has an internal surface 15 facing the inner space 10 and an outer surface 16 facing away therefrom, which thus defines an outer circumference 17 for the holding container 5. Thus there is defined by the inner surface 15 of the container wall 12 with the inner clear dimension 14 an internal cross-section 18, which can have the most varied cross-sectional shapes, such for example as circular, ellipsoid, oval, polygonal, etc. By means of the internal dimension 14 plus twice the wall thickness 13 of the holding container 5, there is formed therefore an external dimension 19 with an external cross-section 20. The shape of the outer cross-section 20 can in turn be circular, ellipsoid, oval, polygonal, etc.; it is however also possible to construct the shape of the outer cross-section 20 as different from the shape of the internal cross-section 18.

It is further possible that the internal dimension 14 and the external dimension 19 of the holding container 5, starting from one end area 6 towards the other end area 7 spaced apart therefrom, to be designed in functional terms as preferably continuously minimally reducing, in order for example to be able to remove the holding container 5, when the latter is manufactured from plastic by injection moulding, simply from the injection moulding tool. Centrally to the internal diameter 14 or to the internal cross-section 18, the holding container 5 has a longitudinal medial axis 21 extending from the end area 6 towards the end area 7.

As may be further seen from this view, the end area 6 has an open end face 22, which is closable by the closure device 8, which may be opened as necessary. For this purpose the closure device 8 consists of a cap 23, surrounding the open end face 22, with, secured therein, a seal device 24, such for example as a seal stopper 25 made of a penetrable highly elastic and self-closing material, such for example as pharmaceutical rubber, silicon rubber or bromobutyl rubber. This cap 23 is located concentrically to the longitudinal medial axis 21, and is formed by an anularly-shaped cap shell 26. Between the cap 23 and the seal device 24 there are provided means for coupling, such for example as coupling parts 27 to 30 of a coupling device 31, comprising in the case of the cap 23 extensions 32, 33 located at least in areas over the internal circumference, if necessary a securing ring 34, and in the case of the seal device 24 consisting of at least a projection 35 projecting at least at points over its outer circumference. In the present embodiment, the seal device 24 is formed by the seal stopper 25, and has a surrounding cylindrical seal surface 36, located roughly concentrically to the longitudinal medial axis 21 and which, in its sealing position, comes into contact in the portion of the end area 6 on the internal surface 15 of the holding container 5. Thus, in this portion, the inner surface 15 of the holding container 5 is to be formed in its surface quality as a seal surface. Furthermore, the seal device 24 has a further seal surface 37 aligned roughly perpendicular to the longitudinal medial axis 21, and which closes or seals, along with the seal surface 36 in contact on the inner surface 15, the inner space 10 of the holding container 5 at its open end face 22 from the external environment. Due to the arrangement of the extension 33 between the projection 35 projecting above the seal surface 36, and the end face 22 of the holding container 5, gluing or strong adhesion of the projection 35 directly on the end face 22 can be avoided.

Furthermore, the seal device 24 may preferably have on the side facing the securing ring 34 a recess 38, which has a substantially identical cross-sectional area as an opening 39, this opening being so dimensioned that unhindered passage and subsequent penetration through the seal device 24 is possible.

The projection 35 forming the coupling part 29, which projects over the seal surface 36 of the seal device 24 at least in part areas of the circumference in the manner of a flange, is secured between the extensions 32 and 33, which are located in two planes spaced apart from one another in the direction of the longitudinal medial axis 21 and mounted perpendicularly thereto, and designed for example as at least partly or also anularly surrounding projections or blocking extensions. In order to secure the seal device 24 reliably in the cap 23 it is also possible to insert the securing ring 34 between the projection 35 and the extension 32. Thus the securing ring 34 has a larger external diameter than an internal diameter formed between the extensions 32 in the perpendicular direction to the longitudinal medial axis 21. Likewise, the diameter of the opening 39 of the securing ring 34 is smaller than the largest external dimension of the projection 35 in a plane perpendicular to the longitudinal medial axis 21. The outer dimension of the seal device 24 however is so dimensioned that it is greater by at least twice the wall thickness 13 of the holding container 5 than the inner dimension 14 of the internal cross-section 18 and thus of the internal space 10. As the extension 33, which forms the coupling part 28, has an internal opening width which corresponds substantially to the internal dimension 14 of the holding container 5, there is very good holding of the projection 35 in the cap 23 and a good seal between the internal space 10 of the holding container 5 and the atmosphere surrounding the holding device 1.

Above all, the impermeability of the closure device 8 for the open end face 22 of the holding device 1 is further improved if an external diameter of the seal device 24 in the region of its seal surface 38 in the relaxed condition outside the holding container 5 is greater than the internal dimension 14 of the holding container 5.

Furthermore, in the relaxed, un-mounted condition, a longitudinal or vertical extension of the projection 35 of the seal device 24, seen in the direction of the longitudinal medial axis 21, is greater than the distance of a groove-shaped recess between the two extensions 32, 33 and if necessary minus a thickness of the securing ring 34. Due to the differences in measurement described above between the groove-shaped recess and the longitudinal dimensions of the projection 35 or the thickness of the securing ring 34, there is an initial bias of the projection 35 between the two extensions 32, 33. This simultaneously brings about a seal and an initial bias of the seal device 24 in relation to the cap 23. This likewise additionally brings about a secure seat of the securing ring 34, and a closed contact of the two end faces of the projection 35 in the region of the two extensions 32, 33.

It is further of advantage if the cap shell 26 is in the form of a truncated cylindrical shell or truncated conical shell, ensuring that the cap shell 26 overlaps in the area of the upper end face 22.

It can further prove advantageous if, in the region of the open end face 22 of the holding container 5, at least two guide extensions 40, 41 are located, which project beyond the external circumference 17 of the cylindrical holding container 5. However, any optional further number of guide extensions 40, 41 is possible, these co-operating with guide webs 42, 43 located on an inner surface of the cap 23 facing the holding container 5, and projecting over their surface in the direction of the longitudinal medial axis 21. In this case the number and the e.g. uniform angularly off-set subdivision of the guide webs 42, 43 over the circumference, is dependent on the number of the guide extensions 40, 41 located on the holding container 5. These guide extensions 40, 41, act in conjunction with the guide webs 42, 43 located on the inner side of the cap shell 26, making it possible, when the cap 23 is pushed on in the direction of the longitudinal medial axis 21 of the holding container 5 in the direction of the open end face 22 thereof, and upon corresponding rotation clockwise, the guide webs 42, 43 run up onto the guide extensions 40, 41, and, due to the combined rotational and longitudinal movement resulting from the guidance of the guide webs 42, 43 along the guide extensions 40, 41, the seal device 24 can be inserted or pushed in with its seal surface 36 into the inner space 10 of the holding container.

As is further to be seen from combined consideration of FIGS. 1 and 2, the holding device 1 has at the end area 7 facing away from the end area 6 the further closure device 9, which is formed by a penetrable seal member 44 made of a penetrable, highly elastic and self-closing material, particularly a rubber, pharmaceutical rubber, silicon rubber of bromobutyl rubber, and of a retaining member 45 for holding the seal member 44 on the holding container 5. On the one hand the retaining member 45 has means of coupling, such for example as one or more coupling parts 46 of a coupling device 47 between the retaining member 45 and the holding container 5, and on the other hand retaining means, such for example as one or more retaining parts 48 of a retaining device 49, of the seal member 44 in a sealing position in an opening 50 tapering towards the inner space, and diametrically opposed to the seal member 44. Thus the surface of the opening 50 is to be designed in its surface quality as a seal surface.

The seal member 44 is conical, particularly designed as a truncated cone with a conical angle 51, and has an end face 52 facing the retaining member 45, with a diameter 53, and a further end face 54 facing away therefrom and (facing) the inner space 10 of the holding container 5, with a diameter 55 smaller than the diameter 53. The holding container 5 has in its end area 7 the previously described opening 50 formed diametrically opposed to the conical angle 51 of the seal member 44, and into which the seal member 44 can be inserted in order to close and seal the inner space 10 from the outer atmosphere, and is securely held by means of the retaining member 45 in this sealing position. For this purpose the opening 50 of the side of the holding container 5 facing away from the inner space 10 has a diameter 56 and a diameter 57 in the area of the inner space 10. In this case the diameter 55 of the end face 54 of the seal member 44 is preferably greater than the smallest diameter 57 of the opening 50 accommodating the seal member 44. Furthermore, the largest diameter 53 of the seal member 44 is greater than the largest diameter 56 of the opening 50 likewise accommodating the seal member 44. This on the one hand ensures that the end face 54 of the seal member 44 facing the inner space 10 does not project over an inner base surface 58 of the holding container 5 into its inner space 10, and on the other hand that a further end face 59 does not come into contact, in the end area 7 of the holding container 5, on a surface of the retaining member 45 facing the inner space 10, so that a spacing 60 is formed between the end face 59 and the inner surface of the retaining member 45. This spacing 60 serves to ensure that, if any manufacturing inaccuracies occur between the opening 50 of the holding container 5 and an outer seal surface 61 of the penetrable seal member 44, a secured and sealing contact of the seal surface 61 is effected in the opening 50. In this case also a slight initial bias of the seal member 44 in co-operation with the retaining member 45 can be achieved in the direction of the inner space 10.

This sealing contact of the seal member 44, particularly of the seal surface 61 in the opening 50, is effected by the retaining means already described of the retaining member 45, which project from outside into a central middle area of the retaining member 45 to such an extent that these, when mounted on the holding container 5, project over the largest diameter 53 of the seal member 44 in a direction of the middle area, i.e. in a radial direction in the direction of the longitudinal medial axis 21. Thus the retaining device 49 can be formed from individual retaining parts 48 distributed over the circumference and/or by an end wall 62 of the retaining member 45 with an opening 63 located in its central region. This opening 63 has an opening width 64 which is at least smaller than the largest diameter 53 of the seal member 44. Thus secure holding of the seal member 44 with respect to the holding container 5 in its inserted position is reliably ensured.

In this design of the retaining member 45 shown here, it is cap-shaped and has the means already described for coupling to the holding container 5. Thus the coupling parts 46 forming these, for example, may be formed by retaining, resiliently engaging, or snap-in arms, which are designed to be deformable and elastically returnable in the radial direction of the retaining members 45. It may further be seen that the coupling parts 46 of the coupling device 47, in the position mounted on the holding container 5, project beyond the outer dimension 19 or beyond the outer circumference 17 of the holding container 5 in the direction of its longitudinal medial axis 21. Thus a maximum outer dimension 65 of the retaining member 45 can be equal to and/or slightly greater than the maximum outer dimension 19 of the maximum outer cross-section 20 of the holding container 5. This ensures that the outer dimension 19 of the holding device 1 has, in the end area 7, despite the arrangement of the closure device 9, no or only a slight enlargement of the outer dimension 65.

In order to design the coupling device 47, the holding container 5 has in its end area 7 a groove 66, designed roughly diametrically opposite the coupling part 46, and which for example extends around the entire outer circumference 17 and/or is formed by groove portions 67 distributed segmentally over the circumference. The arrangement and design of the groove 66 or of the individual groove parts 67 or recesses, etc. are dependent on the design of the retaining member 45. Irrespective of this, however, it is also possible for the coupling device 47 to be formed by receiving bores distributed over the circumference, and preferably tapering conically inwards, which co-operate with individual pin-like coupling parts 46, designed diametrically opposite thereto, on the retaining member 45. It would however also be possible to design a coupling device 47 between the retaining member 45 and the holding container 5 in such a way for example that coupling parts are located projecting over its outer circumference, which co-operate with a groove-shaped arrangement or groove parts of the retaining member 45. Thus likewise the design of the coupling device 47 between the retaining member 45 and the holding container 5 is likewise ensured.

As is further to be seen from FIG. 1, the holding container 5 has in its end area 7, in which is located the opening 50 for insertion of the seal member 44 or for filling the inner space 10, a wall thickness greater than the wall thickness 13 of the container wall 12, so that the opening 50 or the coupling device 47 may be produced in this end area 7. It is further advantageous if the coupling device 47 is located on the outer circumference 17 of the holding container 5 in a position covering the opening 50, so that a favourable design in terms of strength of the end area 7, due to the greater wall thickness in this section, can be achieved. There is further shown in the inner space 10 of the holding container 5 the separating device 11, formed by a seal device 68, in the present embodiment made of a seal member 69 of a first material and a carrier body 70 of a second material differing therefrom. The seal member 69 of the seal device 68 is located in a recess 72 arranged in a preferably angular way in a side wall 71 of the carrier body 70, and thus projects beyond the side wall 71 of the carrier body 70, preferably continuously over its circumferential direction. It is advantageous if the material for the seal member 69 is deformable so as to be resiliently returnable, and e.g. formed from a silicon rubber, pharmaceutical rubber, bromobutyl rubber, rubber, a gel or an elastomeric plastic. The most varied materials and also cross-sectional shapes can be used for the seal member 69, e.g. an O-ring, a flange-ring or a surrounding seal lip, or alternatively a thin-walled blade being usable as a seal member 69, e.g. in grooves and/or clamp areas or the like. It is however possible to secure the seal member 69 by a moulding-on procedure on to the carrier body 70.

It is further advantageous if the second material of the carrier body 70 is liquid-tight, and has a density and/or hardness higher than that of the first material of the seal member 69, and is formed by a plastic provided if necessary with loading materials or fillers, such for example as a duroplast, a glass-clear polystyrol and the like. Furthermore, the carrier body 70 is intended to have a gas permeability which almost prevents the permeation of gases at least in a period of 72 hours. it has also proved advantageous if the overall weight of the carrier body 70 and/or of the separating device 11 is variable, it for example being possible precisely to coordinate the separating device 11 and/or the carrier body 70 to different media 3, 4 of the mixture 2 to be separated. It is further advantageous if the gas permeability of the seal member 69 is at least equal to or greater than that of the carrier body 70.

As already described, the separating device 11 consists of at least one seal member 69 made of a first material and the carrier body 70 made of a second material different from the first. In order to achieve an exact physical separating procedure of the two media 3, 4 of the mixture 2 during the centrifuging process, the specific weight or density of the second material of the carrier body must on the one hand be smaller than the higher specific weight of density of one of the media 3, 4 to be separated by the separating device 11, and on the other hand greater than the lighter specific weight or density of a medium 3, 4 to be separated by the separating device. In this respect it has proved advantageous if for example the density of the carrier body 70 comes to between 1.03 g/cm3 and 1.06 g/cm3, preferably 1.05 /cm3.

Depending on the mixture 2 to be separated from the various media 3, 4 or ingredients, it can prove advantageous if at least part areas or the entire inner surface 15 of the inner space 10 are provided with a coating 73, in order for example in this way to reinforce the sliding movement of the separating device 11 during the separating procedure and/or to effect a chemical and/or physical influence on the mixture 2 or the like. In a preferred contact of the carrier body 70 on one of the closure devices 8, 9, at least the surface 15 located between the separating device 11 and the oppositely-lying end area 6, 7 can be provided with this coating 73, which is releasable or soluble from the surface 15, for example upon contact with the mixture 2, and e.g. can be used simultaneously for fixing the separating device 11.

Furthermore, when the closure devices 8, 9 are mounted on both its ends, before use of the holding device 1, i.e. before it is filled, the inner space 10 can be evacuated or reduced to an air pressure lower than the external air pressure, in order to simplify introduction of the mixture 2 to be filled into the internal space. In order to avoid wetting two sides of the separating device 11 before the filling procedure, it is advantageous if the separating device is located close to one of the two closure devices 8, 9, particularly in contact with one of these two.

Figure 3:
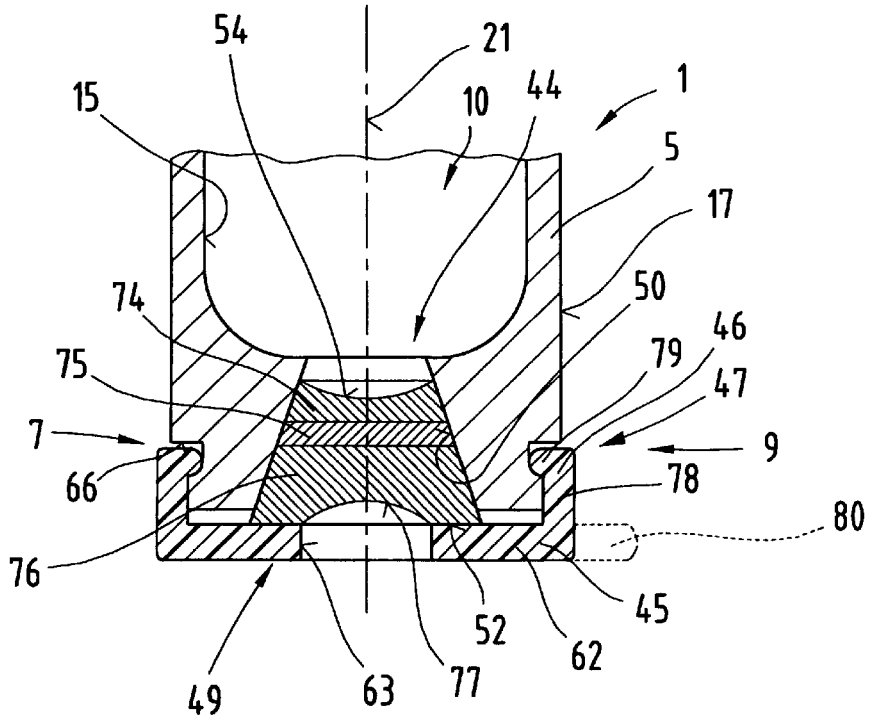
FIG. 3: a further possible embodiment of a closure device for the holding device in side elevation, in section and in a simplified schematic view.
Figure 4:
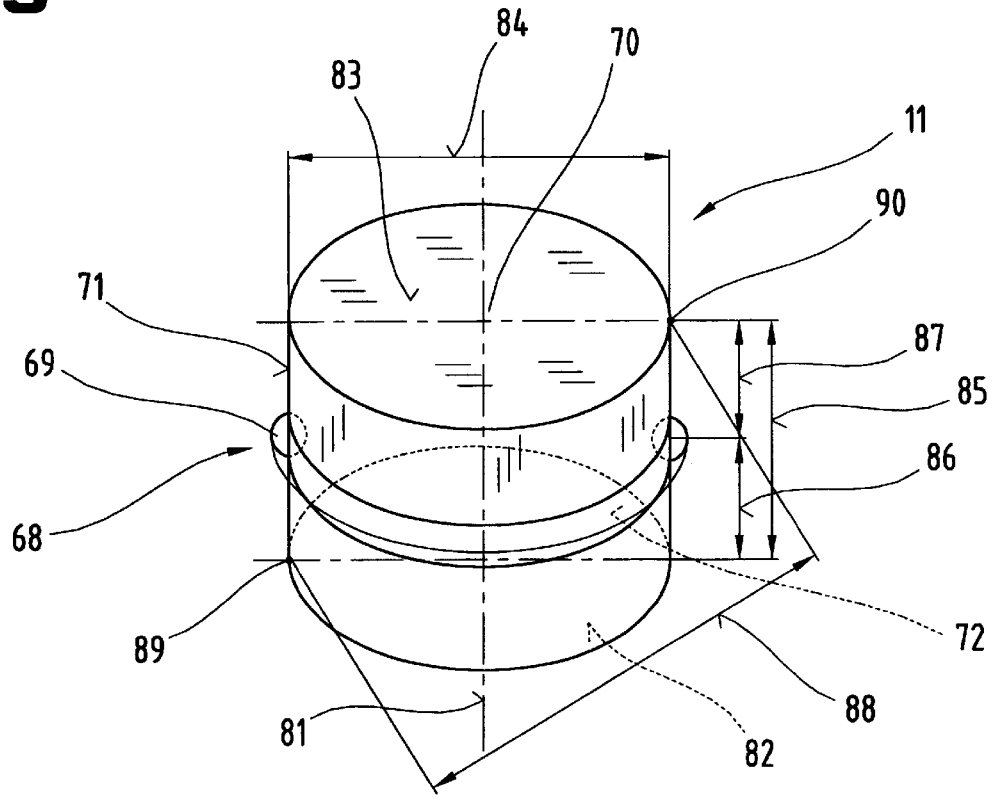
FIG. 4: a possible design of a separating device for the holding device, in a simplified pictorial view.

FIG. 3 shows a part area of the holding device 1 on an enlarged scale, identical reference numbers being used to those in FIGS. 1 and 2 for identical parts. The construction of the closure device 9 shown here, comprising the retaining member 45 and the penetrable seal member 44, differs from the embodiments described above; these different embodiments naturally can form independent solutions in themselves, and can be combined in any way with other described embodiments and other Figures.

The end area 7 of the holding container 5 again has the opening 50 tapering conically in the direction of the inner space 10, and into which the seal member 47 is inserted in a sealing position. In this embodiment it is shown that a seal member 44 is formed by a multiple-layer component of materials in particular different from one another, such for example as the layers 74 to 76. Thus for example the two layers 74, 76, spaced apart from one another can consist of a softer material better suited for sealing, and the layers 75 of a material harder than this and for example serving as carrier layers. It is further possible for the end face 52 of the seal member 44 facing the retaining member 45 to be designed with a concave recess 77 shown in simplified form, or to be located therein. Irrespective of this, for example, the further end face 54 of the seal member 44 lying opposite the end face 52, can be entirely concave in design. By means of the combination of the concave recess 77 or of the entirely concave end face 54, the penetration thickness of the seal member 44 can be adapted to various circumstances, such for example as a needle diameter.

The retaining member 45 is again cap-shaped and has in its end wall 62 facing the seal member 44 again the above described opening 63, in order to ensure penetration through the seal member 44. The retaining device 49 between the retaining member 45 and the seal member 44 can be constructed according to one of the embodiments already described.

Starting from the end wall 62 of the retaining member 45, there is located in its outer lateral area a surrounding collar 78 extending in the direction of the holding container 5, and connected therewith. This collar 78 can for example form a part of the coupling device 47, particularly a coupling part 46, and be expandable and elastically returnable due to the selected material of the retaining member 45. In its end area of the collar 78 facing away from the end wall 62, said collar can be fitted with a collar-like coupling member 79 projecting inwardly over a part area of the collar 78 in the circumferential direction. Naturally it is however also possible to arrange the coupling member 79 as entirely surrounding, like the collar 78 on the retaining member 45, in order in this way to control the coupling force between the holding container 5 and the retaining member 45 and consequently thus the sealing force between the seal member 44 and the opening 50 of the holding container 5.

The coupling member 79 of the coupling device 47 can again engage in the above described groove 66 in the holding container 5, the groove 66, as already described, being entirely surrounding or if necessary only in areas.

It is however also possible for the seal member 44 to be secured, glued or produced by a moulding-on process or by a two-component injection moulding process or connected therewith, on the retaining member 45. Irrespective of this, however, the seal member 44 and the retaining member 45 may also be formed from one component, i.e. as a one-piece component, and thus preferably from a highly elastic and self-closing material, particularly a rubber, pharmaceutical rubber, silicon rubber or bromobutyl rubber.

For the sake of completeness it should be pointed out that the carrier body 70 can have with its seal member 69 all the possible cross-sections for its use, this cross-section having to correspond to the cross-section of the inner surface 15 of the holding device 1, in order to achieve the desired application.

Due to the above described outer diameter 84 and to the constructive height 85 of the carrier body 70, a diagonal corner dimension 88 can be calculated for the carrier body 70, which in every case must be greater than the internal dimension 14 or than the internal cross-section 18 of the holding container 5, in order reliably to avoid tilting of the carrier body 70 about a plane transverse to the medial longitudinal axis 81. This is of great importance during and after the physical separation procedure of the two media 3, 4 of the mixture 2, as otherwise the media 3, 4 of the mixture 2, separated from one another, could not be held apart from one another in a sealed manner after termination of the separating procedure by the separating device 11.

This corner dimension 88 is located between an intersection point 89 of the end face 82, here lower, with the side wall 71 and a further intersection point 90 lying diametrically opposite the intersection point 89, between the end face 83 lying opposite the lower end face 82 and the side wall 71, preferably aligned centrally to the central longitudinal axis 81. Thus the side wall 71 is aligned parallel to the constructive height 85, the two end faces 82, 83, in the region of the surrounding lateral edges of the side wall 71, being respectively arranged in a plane perpendicular to the constructional height 85.

In the case for example of a carrier body 70 which is circular in design, this diagonal corner dimension 88 can be obtained or calculated by the Pythagorus theorem from the root of the sums of the squares of the outer dimension 84 and the constructive height 85 extending perpendicularly thereto. This diagonal corner dimension 88 must in each case be greater than the internal dimension 14 in the inner cross-section 18, aligned perpendicularly to the longitudinal medial axis 81, of the inner space 10 of the holding container 5 accommodating the separating device 11. In this way in fact an oblique positioning of the separating device 11, i.e. an angled alignment of the central longitudinal axis 81 of the carrier body 70 with respect to the longitudinal medial axis 21 of the holding container 5 is possible, while yet complete tilting and thus an un-sealed condition between the seal device 68 and the inner surface 15 of the holding container 5 is reliably avoided. In this case it is essential that the maximum deformation path 91 of the seal device 68, particularly of the seal member 69, is greater, in the direction extending perpendicularly to the central longitudinal axis 81 of the seal member 69 in the direction projecting over the carrier body 11, than a measurement difference of the seal member 69 in a direction perpendicular to the longitudinal medial axis 21 in the relaxed inoperative position, and in the biased position when inserted in the inner space 10 of the holding container 5.

Figure 5:
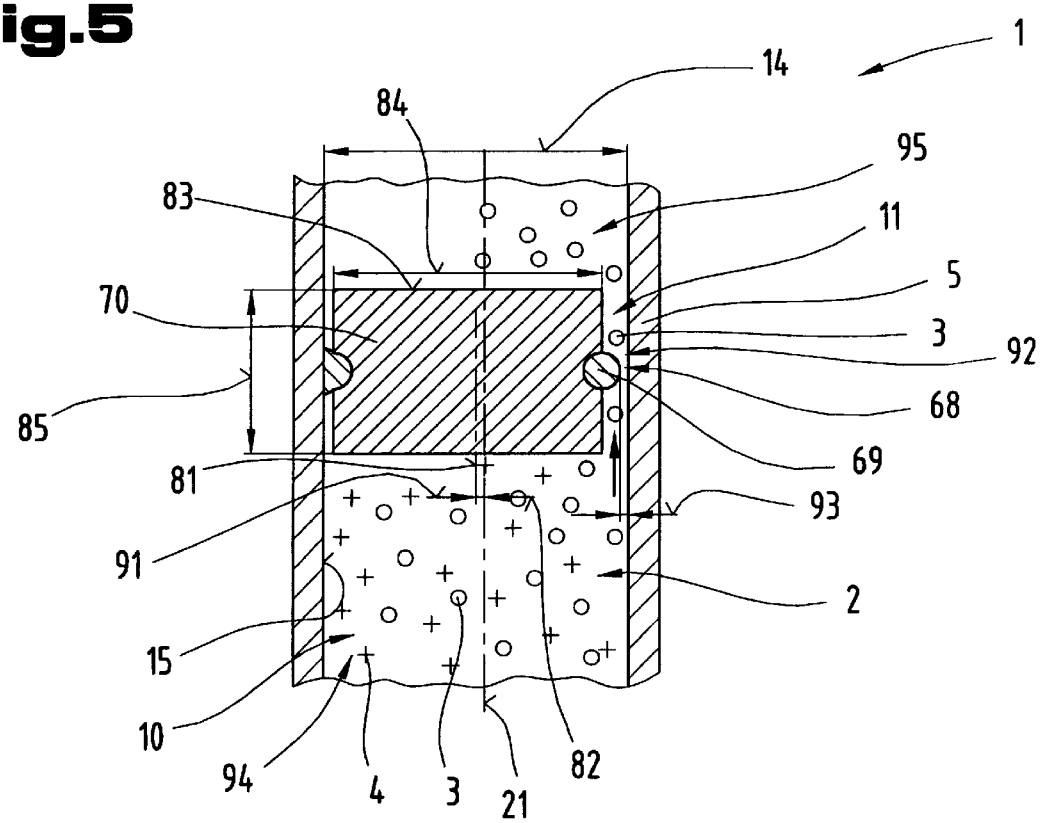
FIG. 5: a holding device with a separating device located in its inner space, during the separating procedure, in side elevation, in section and in a simplified schematic view.
Figure 6:
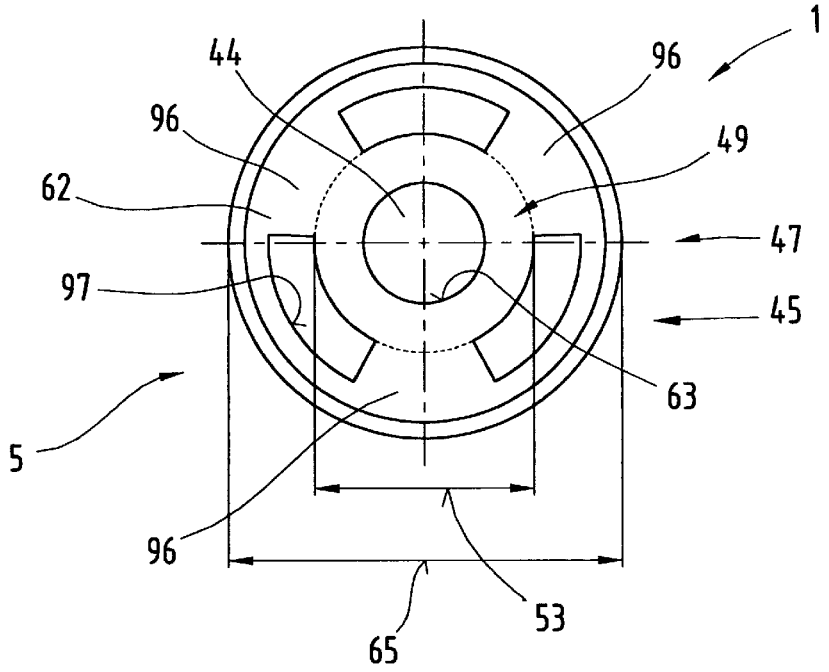
FIG. 6: a possible and if necessary independent embodiment of a retaining member or of a cap in plan view, and in a simplified, schematic view.

FIG. 6 shows a further possible embodiment, if necessary independent in itself, of the retaining member 45 in front view and on an enlarged scale, the same reference numbers being used for identical parts as those in FIGS. 1 to 5. Naturally, the embodiments described here, especially the front wall 62, can also be used in the cap 23 of the closure device 8, and may be arranged instead of the extensions 32. Thus also if necessary the securing ring 33 may be omitted, the projection 35 coming into direct contact with the inner side of the cap 23 facing the inner space 10.

In the region of the front wall 62, the retaining member 45 again has the retaining device 49 for the penetrable seal body 44 for sealing contact of the same in the opening 50 of the holding container 5. The retaining device 49 may for example be designed as a circle with the opening 63 located in its centre or central region, which is connected via webs 96 to the coupling device 47 located in the region of the maximum external diameter 65. The same number of passages 97 are located between the webs 96, seen in the radial direction, said passages extending in the circumferential direction between the individual webs 96. Both the number of webs and their arrangement and dimensions and consequently also those of the passages 97 are freely selectable, so that the angular distribution of the individual webs 96 or passages 97 may be symmetrical to one another. The opening 63 in the centre of the retaining member 45 serves to ensure unhindered penetration through the seal body 44 into the inner space 10 of the holding device 1.

Figure 7:
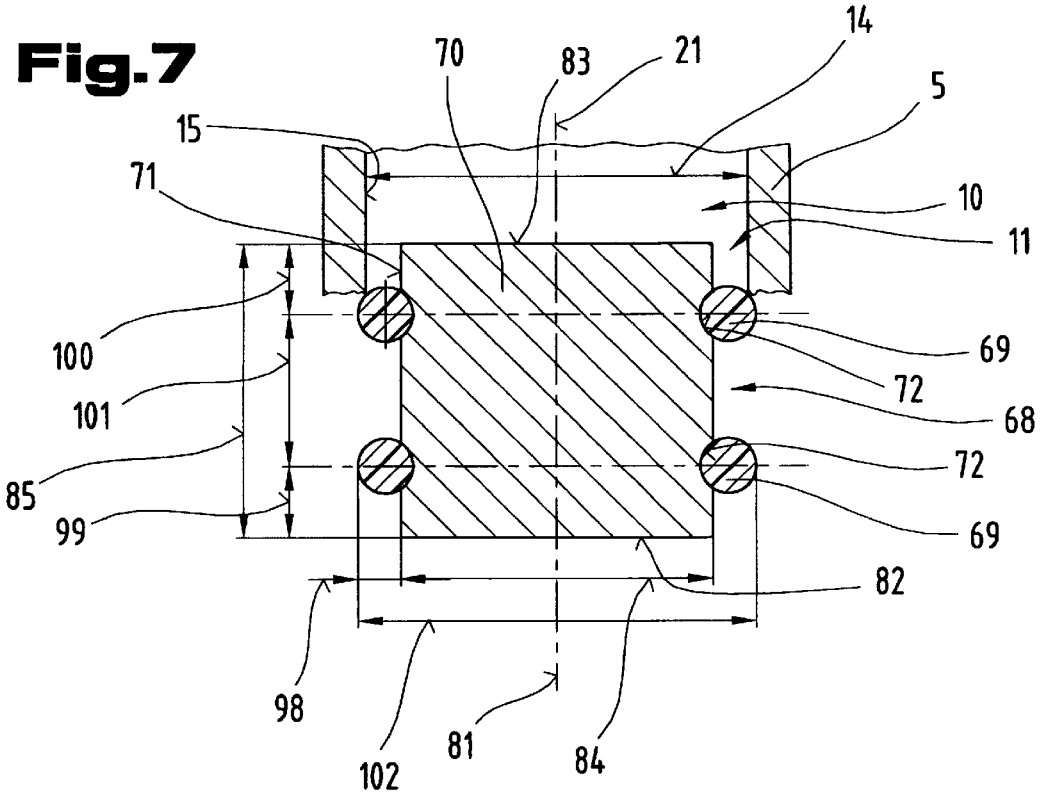
FIG. 7: a further and if necessary independent embodiment of a separating device in side elevation, in section and in simplified schematic view.

FIG. 7 shows a further embodiment, if necessary independent in itself, of a separating device 11 with a portion of the holding device 1, again the same reference numbers as those in FIGS. 1 to 6 being used for identical parts.

The separating device 11 shown here consists in its turn of the carrier body 70 and of the seal device 68 located thereon, which in the present embodiment is formed from two seal members 69 located at a distance one from another, in the direction of the central longitudinal axis 81 of the carrier body 70. The carrier body 70 again has the external dimension 84, the central longitudinal axis 81 extending in its centre. This external dimension 84 is defined by the preferably continuously surrounding side wall 71, upon which the two seal members 69 are also located. These seal members 69 can again be inserted in the recesses 72 of the carrier body 70, the seal members 69 having a continuous overlap 98 over the side wall 71 aligned parallel to the central longitudinal axis 81, said overlap preferably having a uniform value.

The carrier body 70 is further defined in its longitudinal extension by the two end faces 82, 83 aligned perpendicularly to the central longitudinal axis 81, the constructive height 85 being formed between said end faces 82, 83. In the double arrangement of the seal members 69 for the seal device 68 shown here, an average of the recesses is located at a lateral distance 99, 100 from the end faces 82, 83, a spacing 101 being formed between the two seal members 69. By means of this at least double arrangement of the seal members 69 at the spacing 101 from one another in the direction of the central longitudinal axis 81, tilting of the entire separating device during the physical separation procedure is reliably avoided.

As is further to be seen from this illustration, the separating device 11 has a maximum cross-sectional dimension 102 in the area of the seal members 69 in a plane perpendicular to the central longitudinal axis 81, which is formed from the external dimension 84 of the carrier body 70 as well as the double overlap 98 of the seal member 69 over the carrier body 70. This cross-sectional dimension 102, in the relaxed position, not inserted in the inner space 10, is at least equal to or to a certain extent greater than the internal dimension 14 in a plane likewise aligned perpendicularly to the central longitudinal axis 21 of the holding container 5. Due to the preferably slight diameter differences, there is a sealing contact of the seal members 69 on the inner surface 15 of the holding container 5.

It is however of course also possible freely to select the number of seal members 69 for the sealing device 68, and independently of this it is also possible to design differently the cross-sectional shape of the individual seal members 69 over the round embodiment shown here.

For example, the seal members 69 can be formed also by seal lips, seal beads or seal noses in the most varied embodiments. It would also be possible to locate at least one seal member of the seal device 68 eccentrically to the central longitudinal axis 81 aligned parallel to the constructive height 85. It would also however be possible to locate two or more seal members 69 of the seal device 68 diametrically opposite and eccentrically to the central longitudinal axis 81 of the carrier body 70. It can prove advantageous if for example a centre of gravity of the carrier body 70 is located in an end area associated with the medium 3, 4 of the mixture 2 with the higher specific weight or the higher density.

Figure 8:
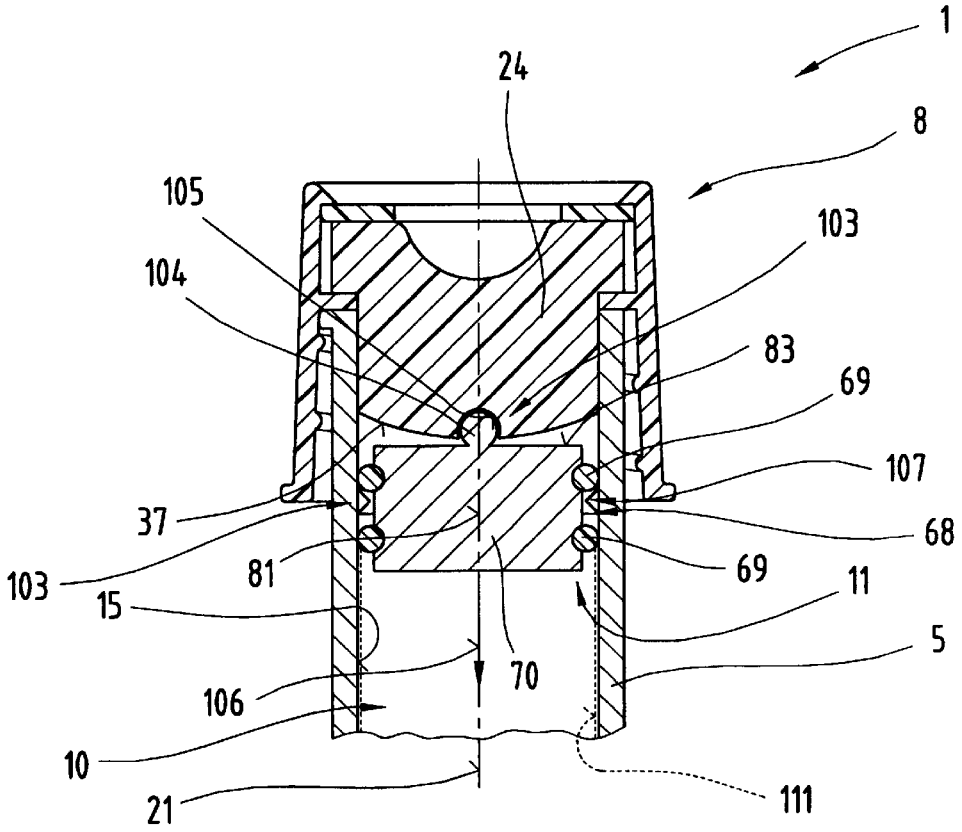
FIG. 8: a further and if necessary independent embodiment of a holding device with a securing device for the separating device in side elevation, in section and in simplified schematic view.

FIG. 8 shows on an enlarged scale and schematically a possible embodiment, if necessary independent in itself, of a further development of the separating device 11 and of the closure device 8 for the holding device 1, the same reference numbers as those in FIGS. 1 to 7 again being used for identical parts. Naturally, instead of the double arrangement of the seal members 69 shown here, any embodiment described above may be used. It is also however possible to transfer the retaining means shown here between the separating device 11 and the closure device 8 in a meaningful way to the further closure device 9.

As already described above, it is necessary to secure the separating device 11 close to one of the two closure devices 8, 9, especially with one of its end faces in contact thereon, before the filling procedure of the mixture 2 into the inner space 10 until the start of the separating procedure. There are various possible ways of doing this, which will be described in this and in the following Figures. In the embodiment shown here, in the area between the end face 83 of the carrier body 70 and the seal surface 37 of the seal device 24 facing it, there is located a securing device 103, in order to hold the separating device 11 in position during the assembly, during the entire storage time of the holding device 1 and during the filling procedure of the inner space 10 with the mixture 2 until the start of the centrifuging process. It can further be seen in the arrangement shown here that the central longitudinal axis 81 of the separating device 11 is located centrally or flush with the longitudinal medial axis 21 of the holding container 5.

In the present embodiment, a securing device 103 consists of at least one roughly spherical retaining extension 104 in the region of the central longitudinal axis 81 of the carrier body 70, and of at least one retaining receiving means 105, formed diametrically opposite thereto, in the central region of the longitudinal medial axis 21 of the seal device 24. The shape of the securing device 103 or of its parts is only shown here by way of example; naturally, any other embodiment is possible. Naturally, however, the retaining extension 104 may also be located on the seal device 24, and the retaining receiving means 105 on the carrier body 70. The essential point is that the retaining extension 104 is secured in the retainer receiving means 105 with a certain retaining force which is sufficient reliably to hold the separating device 11 in its position with respect to the closure device 8 until the start of the centrifuging procedure. The securing device 103, upon reaching a certain centrifugal force, must release the separating device 11, so that this latter, due to its intrinsic weight and the centrifugal force if necessary acting on it in the direction of the arrow 106, is moved, starting from the closure device 8, in the direction of the further closure device 9. The retaining extension 104 preferably overlaps that end face 83, upon which it is located, moulded, etc.

Independently of this, it is however possible, for example, to locate the securing device 103 between the separating device 11 and the holding container 5 and to secure these for example by at least one extension 107 projecting over the inner surface 15 of the holding container 5 in the direction of the central medial axis 21. This extension 107 can be of the most varied design, and may for example be formed by individual extensions 107 distributed over the circumference, or by one extension 107 projecting in the direction of the central medial axis 21 and continuous and in collar shape. The necessary securing force in this case can be influenced and controlled either via the number of individual extensions 107 or if necessary by the length of their projection in the direction of the longitudinal medial axis 21, and can thus be co-ordinated to the various conditions of use. Naturally, however, a combination of the securing device 103 previously described between the separating device 11 and the seal device 24 and between the separating device 11 and the holding container 5 is possible.

Figure 9:
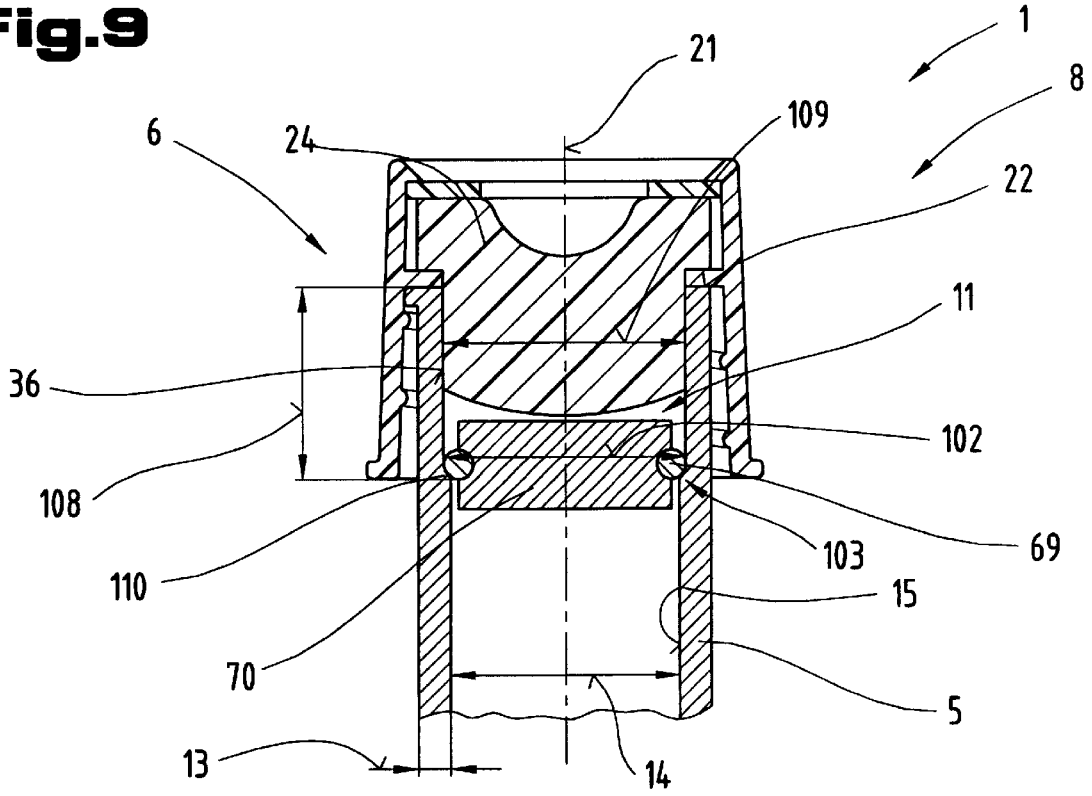
FIG. 9: a further and if necessary independent embodiment of a retaining device for the separating device within the holding device in side elevation, in section and in simplified schematic view.

FIG. 9 shows on an enlarged scale and in a schematically simplified form a further possible and if necessary in itself independent design of the securing device 103 between the separating device 11 and the holding container 5 in the area of the closure device 8 of the holding device 1, the same reference numbers as those in FIGS. 1 to 8 again being used for identical parts.

In the embodiment shown here, the holding container 5 has in its end area 6, in which the seal device 24 of the closure device 8 is inserted, starting from the open end side 22 of the holding container 5 in the direction of the longitudinal medial axis 21, over a length 108, an internal dimension 109 larger with respect to the internal dimension 14, in a plane extending perpendicularly to the longitudinal medial axis 21. Due to the measurement differential between the two internal dimensions 14 and 109, and the larger cross-sectional dimension 102 of the separating device 11 with respect to the internal dimension 14, during assembly, the entire storage duration up to the start of the centrifuging process, there is a supportive contact of one of the seal members 69 of the separating device 11 on a shoulder-shaped projection 110 forming the securing device 103 in the region of the inner surface 15 of the holding container 5. This collar-shaped or shoulder-shaped projection 110 is formed by the previously described measurement differential of the two internal dimensions 14 and 109 from one another. This projection 110 can for example be formed by a reduction in the wall thickness 13 in the region of the end face 22, or by an increase in the same in connection with the length 108.

In selecting the internal dimension 109, it should be taken into account that despite this the seal surface 36 of the seal device 24 comes into a securely sealing contact on the inner surface 15 of the holding container 5 in its end area 6. It is advantageous if the measurement differential between the internal dimensions 14 and 109 comes to between 0.1 mm and 4.0 mm, preferably 1.0 mm. Furthermore, a dimension of the extension 107 or projection 110 projecting over the internal surface 15 comes to between 0.01 mm and 2.0 mm, preferably 0.5 mm.

Figure 10:
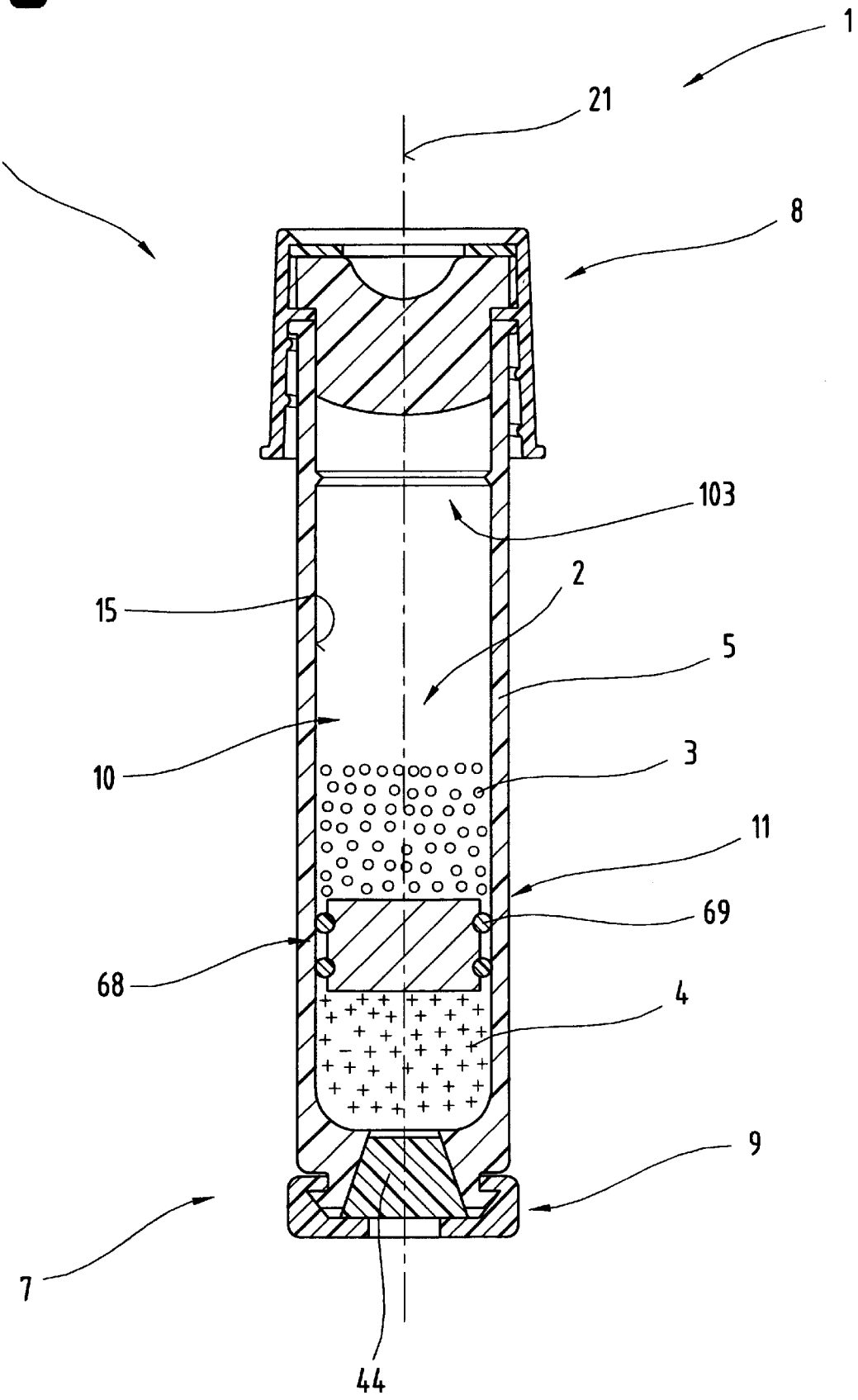
FIG. 10: one of the possible embodiments of the holding device after completion of the separation procedure of the mixture in side elevation, in section and in simplified, schematic view.

FIG. 10 shows one of the possible designs of the holding device 1 after completion of separation of the two media 3, 4 of the mixture 2, the same reference numbers as those used in FIGS. 1 to 9 being used for identical parts. For reasons of simplicity or greater clarity, only one of the possible embodiments of the various components or component groups previously described has been shown; it is of course possible to transfer these different embodiments meaningfully to the holding device shown here.

The holding device 1, consisting of the holding container 5, the two closure devices 8, 9 located in its end area 6, 7 and the separating device 11 located in its inner space 10, is shown in that operational condition in which the mixture 2 has already been spatially separated into its two media 3, 4. Thus the mixture 2, e.g. blood, has been divided into a serum, medium 3, and a plasma, medium 4.

Normally, the centrifuging process of the entire holding device 1 is carried out in a preferably vertical position of the longitudinal medial axis 21, the closure device 8 being located at the upper end of the holding container 5, and the closure device 9 at the lower end of the holding container 5.

As already described above, the inner space 10 of the holding container 5, when ready for operation, is evacuated to a pressure kept beneath atmospheric air pressure, the separating device 11 being in addition located in the close vicinity of or in contact with one of the closure devices 8, 9 as in the present embodiment at the closure device 8. The inner space 10 is here filled in the region of the penetrable seal body 44 of the closure device 9. As FIG. 1 shows, the holding device 1 is shown there after the filling procedure or directly before centrifuging.

As may now be more clearly seen from FIG. 10, the separating device 11 is located between the two separated media 3, 4 of the mixture 2; during centrifuging, the specifically lighter medium 3 is physically separated from the physically heavier medium 4, as has already been described in FIG. 5 for only one seal member. Due to the intrinsic weight of the separating device 11 and the above described selected specific weight or density of the same, this latter sinks into the medium 3 and then floats on the specifically heavier medium 4. Deeper penetration of the separating device 11 into the medium 4 is not possible due to the physical properties described above; the separating device 11, after termination of centrifuging and re-deformation of the seal device 68 with its seal members 69, comes into sealing contact on the inner surface 15 of the holding container 5, and thus renewed admixture of the two media 3, 4 of the mixture 2 is reliably avoided. In connection with this it is for example possible to remove separately from one another out of the inner space 10 the specifically heavier medium 3 from the inner space 10 of the holding container 5 by opening the closure device 8, and if necessary the heavier medium 4 by opening the closure device 9.

Due to the design of the separating device 11 it is for example also possible to separate from one another different volumes of the mixture 2 filled into the inner space 10, without the necessity for taking account of a precise added quantity or filling level in the holding container 5 during its filling. The separating procedure for the two media 3, 4 must continue until it is ensured that the separating device 11 is located between the two media 3, 4 and floats on the physically heavier medium 4.

FIG. 8 further shows schematically that the securing device 103 can be formed for example also by a coating 111, applied to the inner surface 15 of the holding container 5, said coating securing the separating device 11 until the start of centrifuging, in the close vicinity of one of the closure devices 8, 9. It is possible to design the coating 111 in such a way that it serves as a securing device 103 during the entire storage duration of the holding device 1 until the filling procedure, and loses its retaining effect for the separating device 11 only at the immediate start of centrifuging, and serves for example as a sliding means for the separating device 11 during its movement, as it is softened or dissolved or flushed off by the liquid introduced into the holding container 5. The coating 11 may be applied both over the entire surface of the inner surface 15, or only to parts thereof.

Figure 11:
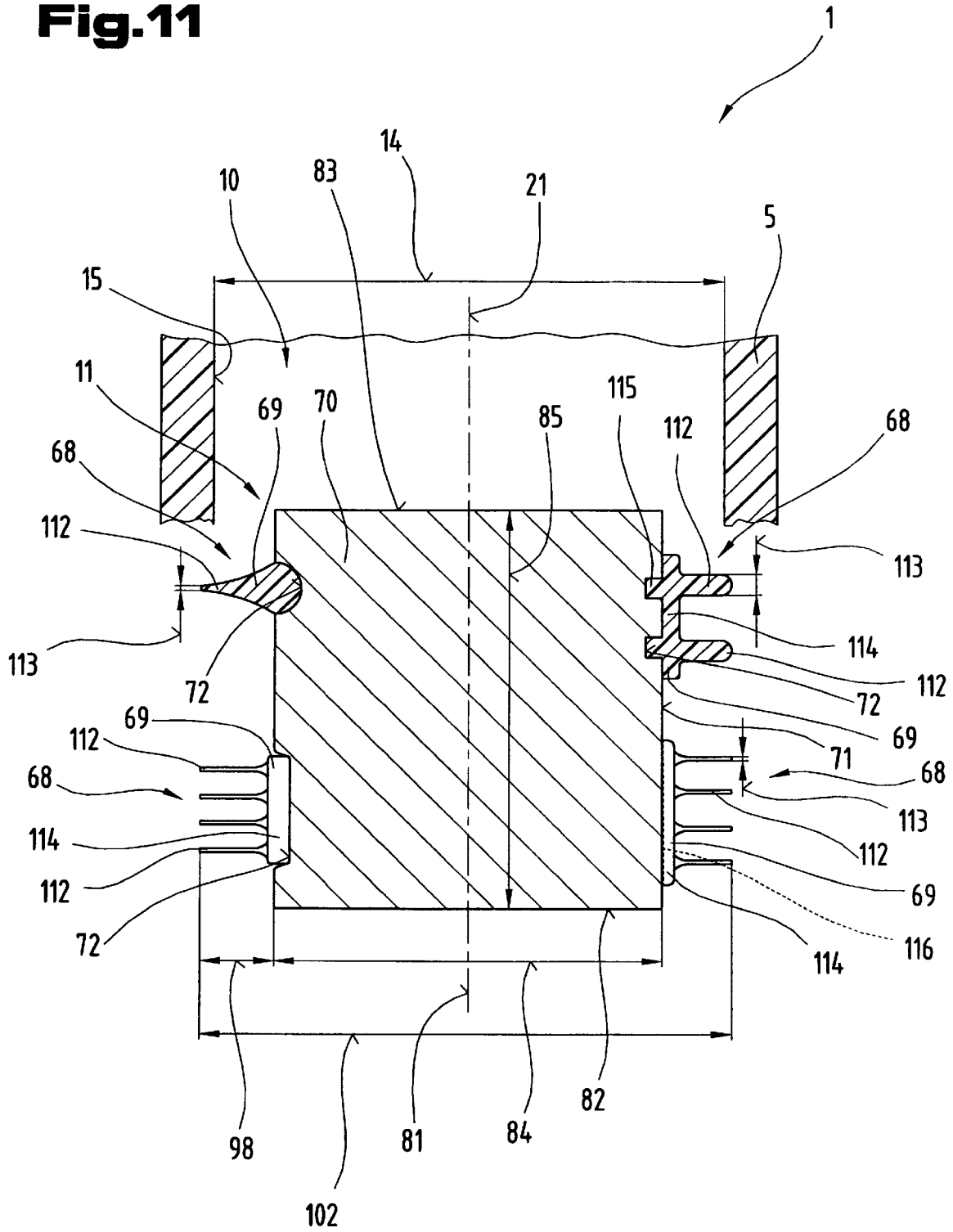
FIG. 11: a further and if necessary independent embodiment of a separating device with differently-designed seal members in side elevation, in section and in simplified schematic view.

FIG. 11 shows a further embodiment, if necessary independent in itself, of a separating device 11 with a portion of the holding container 5 forming the holding device 1, the same reference numbers as those used in FIGS. 1 to 10 again being used for identical parts. In order to be able to illustrate a plurality of different possible designs of the seal device 16, and at the same time to avoid a plurality of illustrations, these have been shown in a common Figure, but in different positions.

The separating device 11 shown here in turn consists of the carrier body 70 with located thereon the seal device 68, which is formed from at least one seal member 69 preferably located centrally to the central longitudinal axis 81 of the carrier body 70.

The carrier body 70 again has the external dimension 84, the central longitudinal axis 81 being located in its centre. This external dimension 84 is defined by the preferably continuously surrounding side wall 71, upon which the various seal members 69 may be located. These seal members 69 may be inserted either in variously designed recesses 72 of the carrier body 70, or be secured on the carrier body 70, the seal members 69 having an overlap 98 over the side wall 71 aligned parallel to the central longitudinal axis 81, said overlap preferably having a uniform value.

The carrier body 70 is further defined in its longitudinal extension by the two end faces 82, 83 aligned perpendicularly to the central longitudinal axis 81, the constructive height 85 again being formed between these. By means of a possible multiple arrangement of the seal members 69 on the carrier body 70 in the direction of the central longitudinal axis 81, tilting of the entire separating device 11 during the physical separating procedure is reliably avoided.

As may further be seen from this illustration, the separating device 11 has a maximum cross-sectional dimension 102 in the area of the seal members 69 in a plane located perpendicularly to the central longitudinal axis 81, which is made up of the external dimension 84 of the carrier body 70 and twice the overlap 98 of the seal member 69 over the carrier body 70. This cross-sectional dimension 102, in the relaxed position not inserted in the inner space 10, is at least equal to or to a certain degree larger than the internal dimension 14 in a plane likewise aligned perpendicularly to the central longitudinal axis 21 of the holding container 5. Due to the preferably slight diameter differences, this leads to a sealing contact of the seal members 69 on the inner surface 15 of the holding container 5.

The seal member 69 shown in the left-hand upper region of the carrier body 70 has a roughly annularly shaped basic body with located thereon, in the direction facing away from the central longitudinal axis 81, an extension 112, which is designed to reduce continuously in its thickness 113 preferably in the direction facing away from the central longitudinal axis 81. The preferably larger-volume basic body of the seal member 69 can be inserted in the groove-shaped recess 72 in the carrier body 70. Naturally, a multiple arrangement of the seal member 69 is possible in order to design the seal device 68.

In the right-hand upper area of the carrier body 70, there is shown a further possible design of the seal member 69, formed from a roughly cylindrical basic body 114 and at least one but preferably a plurality of extensions 112, which project on the side of the separating device 11 facing away from the central longitudinal axis 81. The extensions 112 may likewise in turn be formed with a relatively low thickness 113 in the direction parallel to the central longitudinal axis 81, and can be formed by preferably continuously surrounding thin webs, blades, seal lips or the like. It is also shown here that there is located on the basic body 114 in the area of the side wall 71 at least one projection 115, which extends from the side wall 71 in the direction of the central longitudinal axis 81. This projection 115 may be formed, seen over the circumference, only in areas, and offset to one another, or also continuously surrounding. Naturally, a multiple arrangement of the projection 115 is possible, seen in the direction of the central longitudinal axis 81, a correspondingly-dimensioned recess 72 in the carrier body 70 being associated with this projection 115. In this way it is possible to secure the seal member 69 against an axial movement in the direction of the central longitudinal axis 81 with respect to the carrier body 70, so that the seal device 68, which in the present embodiment is formed by the seal member 69, is fixed in its position relative to the carrier body 70. These previously described and interacting components represent securing means between the carrier body 70 and the seal device 68.

A further possible design of the seal device 68 is shown in the right-hand lower area of the carrier body 70, this embodiment being very similar to the seal member 69 described immediately above. The individual extensions 112 have an even lower thickness 113 compared to the extensions 112 described immediately above, so that an even better seal of the two media 3, 4 to be separated from one another can be achieved after the separation. The individual extensions 112 are again located on a common basic body 114, the basic body 114 here being secured on its surface facing the side wall 71 of the carrier body 70 to the carrier body 70 by means of a schematically-shown adhesive layer 116. The design and arrangement of the adhesive layer 116 depends on the selection of the materials from which the carrier body 70 or the seal device 68 are made, and can naturally be freely selected. It is however also possible to provide, instead of the adhesive layer 116, a pressure sensitive or adhesive seat between the seal member 69 and the carrier body 70 in order in turn to achieve exact positioning of the seal member 69 with respect to the carrier body 70.

In the left-hand lower region of the carrier body 70 there is shown a further design and possible arrangement of the seal member 69 of the seal device 68 on the carrier body 70. In this case the seal member 69 may be designed similarly to the seal member 69 described immediately above, and can in turn be formed from the basic body 114 and located thereon and projecting on the side facing away from the central longitudinal axis 81, the extensions 112. In order to achieve positional fixing of the seal device 68 with respect to the carrier body 70 in the direction of the central longitudinal axis 81, there is associated with the basic body 114 a recess 72, adapted in dimensions thereto, in the carrier body 70, and into which the basic body 114 is inserted.

Due to the embodiments described above it is possible respectively to manufacture the carrier body 70 or the seal device 68 in their own single manufacturing procedure, and then only later to combine them to form the common separating device 11. It is however also possible to mould on, inject on or glue the sealing device 68 in its own working step to the carrier body 70. Furthermore, manufacture of the separating device 11 described above can be carried out in the most varied ways; instead of the previously described separate manufacture and subsequent combination it is also possible to produce the separating device 11 in a co-injection moulding or in a co-extrusion process or in any combination of the above described manufacturing processes. The essential factor here is that there are located between the seal member 69 and the carrier body 70 securing means which ensure mutual positional fixing of the two components relative to one another.

A great advantage compared to previously known holding devices, used for separating different media, also resides in the fact that, due to the design in terms of weight of the separating device 11, floating is effected between the separated media 3, 4, without the necessity for taking note of a precise inserted quantity of the media 3, 4 to be separated before centrifuging.

Naturally it is possible within the scope of the invention optionally to alter the arrangement of the individual elements or to combine them together in different ways, going beyond the embodiments shown by way of example. Individual features from the embodiments shown can represent independent inventive solutions.

It should finally be noted as a matter of order that in order to provide better understanding of the function and design of the holding device according to the invention consisting of the holding container, the separating device and the closure devices, many parts thereof have been shown schematically and on a disproportionately enlarged scale.

In particular, the individual constructions shown in FIGS. 1; 2; 3; 4, 5; 6; 7; 8; 9; 10; 11 form the subject matter of independent inventive solutions. The details and solutions according to the invention relative thereto are to be seen in the detailed descriptions of these Figures.

| List of Reference Numbers |
|---|
| 1. holding device |
| 2. mixture |
| 3. medium |
| 4. medium |
| 5. holding container |
| 6. end area |
| 7. end area |
| 8. closure device |
| 9. closure device |
| 10. inner space |
| 11. separating device |
| 12. container wall |
| 13. wall thickness |
| 14. dimension |
| 15. surface |
| 16. surface |
| 17. external circumference |
| 18. cross-section |
| 19. dimension |
| 20. cross-section |
| 21. longitudinal medial axis |
| 22. end face |
| 23. cap |
| 24. seal device |
| 25. seal stopper |
| 26. cap shell |
| 27. coupling part |
| 28. coupling part |
| 29. coupling part |
| 30. coupling part |
| 31. coupling device |
| 32. extension |
| 33. extension |
| 34. securing ring |
| 35. projection |
| 36. seal surface |
| 37. seal surface |
| 38. recess |
| 39. opening |
| 40. guide extension |
| 41. guide extension |
| 42. guide web |
| 43. guide web |
| 44. seal body |
| 45. securing member |
| 46. coupling part |
| 47. coupling device |
| 48. retaining part |
| 49. retaining device |
| 50. opening |
| 51. conical angle |
| 52. end face |
| 53. diameter |
| 54. end face |
| 55. diameter |

-continued

| List of Reference Numbers |
|---|
| 56. diameter |
| 57. diameter |
| 58. base surface |
| 59. end side |
| 60. spacing |
| 61. seal surface |
| 62. end wall |
| 63. opening |
| 64. opening width |
| 65. external dimension |
| 66. groove |
| 67. groove portion |
| 68. seal device |
| 69. seal member |
| 70. carrier body |
| 71. side wall |
| 72. recess |
| 73. coating |
| 74. layer |
| 75. layer |
| 76. layer |
| 77. recess |
| 78. collar |
| 79. coupling member |
| 80. stop rib |
| 81. central longitudinal axis |
| 82. end surface |
| 83. end surface |
| 84. external dimension |
| 85. constructive height |
| 86. spacing |
| 87. spacing |
| 88. corner dimension |
| 89. intersection point |
| 90. intersection point |
| 91. deformation path |
| 92. slot |
| 93. width |
| 94. collecting space |
| 95. separating space |
| 96. web |
| 97. passage |
| 98. overlap |
| 99. lateral spacing |
| 100. lateral spacing |
| 101. spacing |
| 102. cross-sectional dimension |
| 103. securing device |
| 104. securing extension |
| 105. securing receiving means |
| 106. arrow |
| 107. extension |
| 108. length |
| 109. dimension |
| 110. projection |
| 111. coating |
| 112. extension |
| 113. thickness |
| 114. basic body |
| 115. projection |
| 116. adhesive layer |

What is claimed is:

1. A holding device for body fluid, tissue parts and tissue culture media, comprising (a) a cylindrical holding container having a container wall with an inner surface and an outer surface, the holding container having a first and a second open end face, the inner container wall surface defining an inner space, the first open end face having a diameter which is at least equal to the diameter of the inner space, and the second open end face having a conical sealing surface tapering inwardly in the direction of the inner space, (b) a first closure device for closing the first open end face, the first closure device including (1) a cap surrounding the outer container wall surface, (2) two extensions projecting inwardly from a cylindrical inner surface towards a longitudinally extending medial axis of the holding container, the extensions being arranged in planes extending perpendicularly to the medial axis and being spaced apart in the direction of the medial axis, and (3) a penetrable cylindrical seal device mounted in the cap, a first portion of the seal device forming a sealing surface with the inner container wall surface, and an adjacent flange-shaped seal device portion projecting radially outwardly and being held between the two extensions, one of the extensions projecting inwardly between the first and adjacent portions of the cap, and (c) a second closure device for closing the second open end face, the second closure device including (1) a solid conical seal body having a sealing surface conforming to the conical sealing surface of the second open end face, and an outer end face of a larger diameter than that of an inner end face facing the inner space, (2) a retaining member abutting the outer end face, and (3) coupling means on the outer container wall surface, the retaining member having means for engaging the coupling means and for holding the seal body in a sealing position in the second open end face.

2. The holding device of claim 1, wherein the cap surrounding the outer container wall surface is tubular and has an opening aligned with the first open end face, one of the two extensions being an axially movable retaining ring projecting inwardly beyond the cap opening and the extensions coupling the seal device to the cap by holding the flange-shaped seal device portion therebetween under tension, the flange-shaped seal device portion, when relaxed, having a thickness exceeding the spacing between the two extensions.

3. The holding device of claim 1, wherein the container wall has a thickness at the second open end face surrounding the conical seal body exceeding that of the remainder of the container wall.

4. The holding device of claim 1, further comprising a separating device arranged in the inner space, the separating device comprising a sealing member contacting the inner container wall surface and comprised of a deformable, resiliently restorable first material, and a carrier body comprised of a second material, the sealing member being arranged on the circumference of the carrier body and radially projecting therefrom towards the inner container wall surface.

5. The holding device of claim 4, wherein the inner space is evacuated and the separating device is positioned near one of the closure devices.

6. The holding device of claim 5, wherein the carrier body has an end face adjacent the one closure device.

7. The holding device of claim 5, wherein at least a portion of the inner container wall surface between the separating device and the other closure device is provided with a coating.

8. The holding device of claim 7, wherein the coating is releasable from the inner container wall surface by contact with media filling the inner space.

9. The holding device of claim 4, wherein the second material has a higher density and/or hardness than the first material.

10. The holding device of claim 9, wherein the second material is a thermosetting plastic.

11. The holding device of claim 9, wherein the density of the second material is between 1.03 g/cu.cm and 1.06 g/cu.cm.

12. The holding device of claim 4, wherein the second material is polystyrene.

13. The holding device of claim 4, wherein the carrier body is liquid-impermeable.

14. The holding device of claim 4, wherein the carrier body has a gas permeability of at least 72 hours.

15. The holding device of claim 4, wherein the sealing member is molded onto the carrier body.

16. The holding device of claim 4, wherein the sealing member is an O-ring.

17. The holding device of claim 4, wherein the sealing member is a sealing lip.

18. The holding device of claim 4, wherein the sealing member has a gas permeability at least equal to that of the carrier body.

19. The holding device of claim 4, wherein the carrier body has a lower end face, an upper end face and a side wall extending therebetween, a diagonal distance between a point of intersection between the lower end and the side wall and a point of intersection between the upper end face and the side wall exceeding the diameter of the inner space.

20. The holding device of claim 4, wherein a maximal deformation path, extending perpendicularly to the medial axis, of the deformable, resiliently restorable first material of the sealing member inserted under tension in the inner space exceeds the dimension of a radially projecting portion of the sealing member, when relaxed.

21. The holding device of claim 4, wherein a plurality of said sealing members are arranged on the circumference of the carrier body and are axially spaced from each other.

22. The holding device of claim 21, wherein at least one of the sealing members is eccentrically arranged in relation to the medial axis.

23. The holding device of claim 4, further comprising a securing device for detachably attaching the separating device to one of the closure devices.

24. The holding device of claim 23, wherein the carrier body has two end faces extending perpendicularly to the medial axis, and the securing device comprises a retaining extension projecting from one of the carrier body end faces and received in a securing recess in the one closure device.

25. The holding device of claim 24, wherein the retaining extension and the securing recess are disposed in the medial axis.

26. The holding device of claim 4, comprising a retaining device for the separating device, the retaining device projecting inwardly towards the medial axis from the inner container wall surface.

27. The holding device of claim 26, wherein the retaining device is a circumferentially extending extension on the inner container wall surface.

28. The holding device of claim 26, wherein the retaining device is a coating on the inner container wall surface.

29. The holding device of claim 1, wherein the coupling means comprises a groove in the outer container wall surface.

30. The holding device of claim 1, wherein the diameter of the outer end face of the conical seal body is greater than the greatest diameter of the conical sealing surface of the second open end face.

31. The holding device of claim 1, wherein the diameter of the inner end face of the conical seal body is greater than the smallest diameter of the conical sealing surface of the second open end face.

32. The holding device of claim 1, wherein the retaining member has a cross section that no more than slightly exceeds the outer cross section of the tubular container.

* * * * *